US012551752B2

(12) United States Patent
Van Biezen et al.

(10) Patent No.: US 12,551,752 B2
(45) Date of Patent: Feb. 17, 2026

(54) HIP LOADING EXERCISE BOARD

(71) Applicant: Back Story, LLC, Aspen, CO (US)

(72) Inventors: Troy Van Biezen, Aspen, CO (US); Jon Levy, Aspen, CO (US); William Jeremy James, Aspen, CO (US); Shawn Charles Reed, Aspen, CO (US); Bear Kaminer, Aspen, CO (US); Andrew Raponi, Aspen, CO (US); Shawn Koutahi, Aspen, CO (US)

(73) Assignee: Back Story, LLC, Aspen, CO (US)

( * ) Notice: Subject to any disclaimer, the term of this patent is extended or adjusted under 35 U.S.C. 154(b) by 158 days.

(21) Appl. No.: 18/513,493

(22) Filed: Nov. 17, 2023

(65) Prior Publication Data

US 2024/0165460 A1 May 23, 2024

Related U.S. Application Data

(60) Provisional application No. 63/426,203, filed on Nov. 17, 2022.

(51) Int. Cl.
*A63B 23/04* (2006.01)
*A63B 21/00* (2006.01)
(Continued)

(52) U.S. Cl.
CPC .... *A63B 23/0488* (2013.01); *A63B 21/00061* (2013.01); *A63B 21/00185* (2013.01); *A63B 21/0428* (2013.01); *A63B 21/0552* (2013.01); *A63B 21/4034* (2015.10); *A63B 21/4045* (2015.10); *A63B 71/0036* (2013.01); *A63B 2210/50* (2013.01); *A63B 2220/56* (2013.01); *A63B 2220/833* (2013.01)

(58) Field of Classification Search
CPC ..... A63B 21/00061; A63B 21/00065; A63B 21/00185; A63B 21/0414; A63B 21/0428; A63B 21/0552; A63B 21/4029; A63B 21/4031; A63B 21/4034; A63B 21/4035; A63B 21/4045; A63B 22/20; A63B 22/201; A63B 22/203; A63B 23/047; A63B 23/0488; A63B 71/0036; A63B 71/0622; A63B 2071/0694; A63B 2208/0204; A63B 2209/00; A63B 2210/00; A63B 2210/50; A63B 2220/50; A63B 2220/51; A63B 2220/52; A63B 2220/56; A63B 2220/833; A63B 2225/09; A63B 2225/50
See application file for complete search history.

(56) References Cited

U.S. PATENT DOCUMENTS 3,955,821 A * 5/1976 Spedding ..... A63B 69/3673 473/271
5,976,027 A * 11/1999 Kachmar ..... A63B 69/3667 473/273

(Continued)

FOREIGN PATENT DOCUMENTS

WO WO-0145801 A1 * 6/2001 ..... A63B 23/0417

*Primary Examiner* — Gary D Urbiel Goldner
(74) *Attorney, Agent, or Firm* — Blank Rome LLP

(57) ABSTRACT

A hip loading board for exercise includes linear-motion elements. The linear-motion elements include linear-motion bearing motion elements to provide free motion in one direction. The hip loading board can include one or more interchangeable resistance elements that provide a force to return a moving plate to a start position.

18 Claims, 8 Drawing Sheets

(51) Int. Cl.

| | |
|---|---|
| ***A63B 21/04*** | (2006.01) |
| ***A63B 21/055*** | (2006.01) |
| ***A63B 71/00*** | (2006.01) |

(56) References Cited

U.S. PATENT DOCUMENTS

| | | | | |
|---|---|---|---|---|
| 6,280,366 | B1 * | 8/2001 | Hsieh | A63B 21/4045 482/130 |
| 7,677,988 | B2 * | 3/2010 | McMillan | A63B 69/3661 473/266 |
| 8,414,414 | B2 * | 4/2013 | Viramontez | A63B 26/003 473/270 |
| 9,802,100 | B2 * | 10/2017 | Csencsits | A63B 69/3667 |
| 10,433,612 | B2 * | 10/2019 | Ashby | F03G 5/06 |
| 10,512,814 | B1 * | 12/2019 | Conroy | A63B 21/00069 |
| 2006/0205528 | A1 * | 9/2006 | McMillan | A63B 69/3667 473/279 |
| 2013/0196829 | A1 * | 8/2013 | Elbaz | A43B 7/00 482/79 |
| 2014/0011645 | A1 * | 1/2014 | Johnson | A63B 23/03533 482/121 |
| 2014/0031175 | A1 * | 1/2014 | Peralo | A63B 21/4045 482/66 |
| 2019/0105546 | A1 * | 4/2019 | Ferrara | A63B 21/4037 |
| 2022/0023714 | A1 * | 1/2022 | Holman | A63B 21/0428 |
| 2022/0387847 | A1 * | 12/2022 | True | A63B 21/4033 |
| 2023/0181969 | A1 * | 6/2023 | Cohen | A63B 21/0557 482/8 |

* cited by examiner

HIP LOADING EXERCISE BOARD

PRIORITY

This application claims the benefit of U.S. Provisional Application 63/426,203, filed Nov. 17, 2022, which is hereby incorporated by reference in its entirety.

FIELD OF THE INVENTION

This disclosure relates to exercise equipment and more specifically to providing an exercise board to aid in hip loading exercises.

BACKGROUND

Hip loading exercises can strengthen and increase mobility in the hips. When performed on a regular basis, hip loading exercises stretch and strengthen hip muscles and can help build one's stability and flexibility.

DETAILED DESCRIPTION

Figure 1:
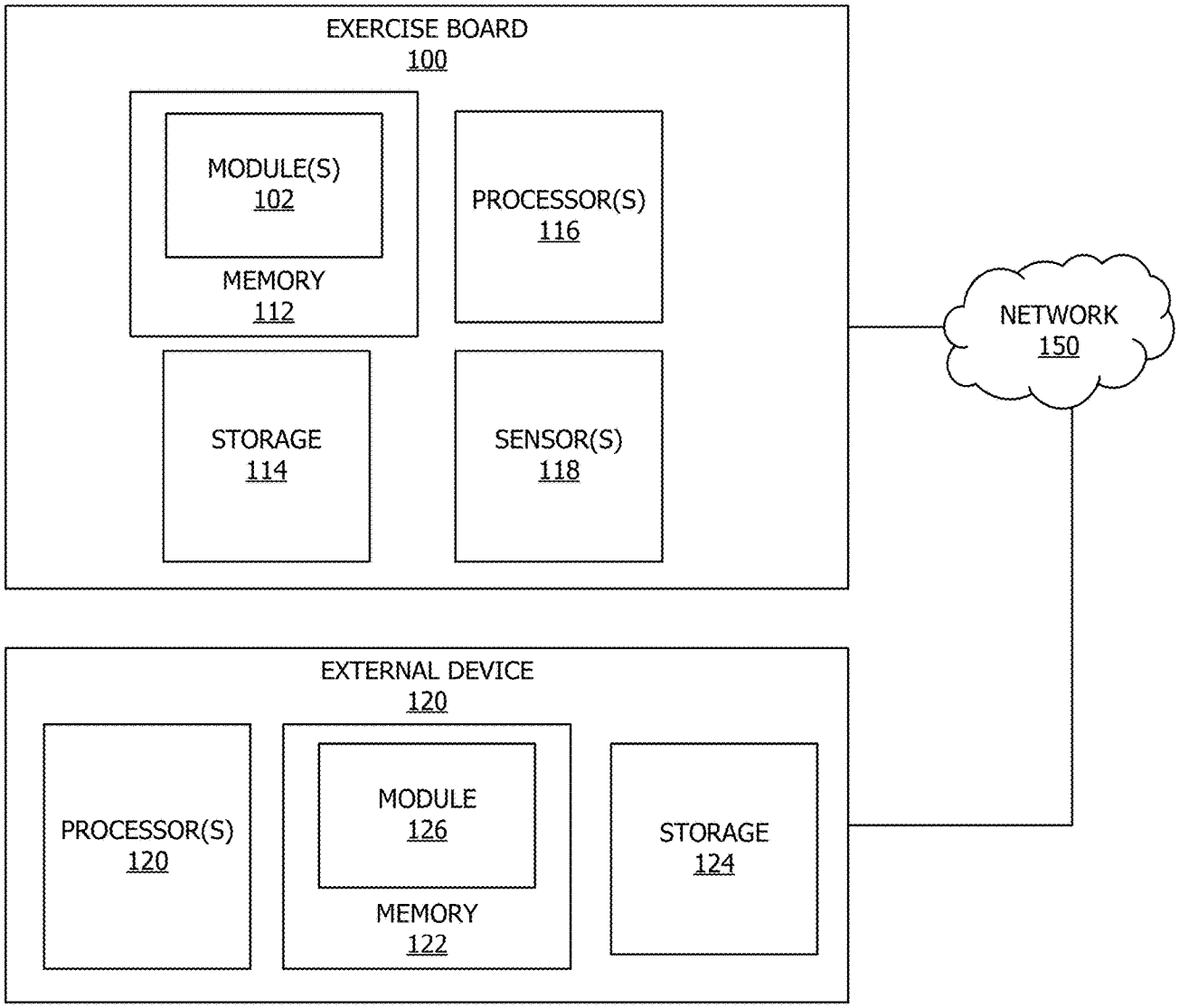
FIG. 1 illustrates, in block diagram form, a simplified network diagram according to one or more embodiments.

Disclosed are a system, method, and article of implementing a hip loading exercise board. The following description is presented to enable a person of ordinary skill in the art to make and use the various embodiments. Descriptions of specific devices, techniques, and applications are provided only as examples. Various modifications to the examples described herein can be readily apparent to those of ordinary skill in the art, and the general principles defined herein may be applied to other examples and applications without departing from the spirit and scope of the various embodiments.

Reference in this disclosure to "one embodiment" or to "an embodiment" means that a particular feature, structure, or characteristic described in connection with the embodiment is included in at least one embodiment, and multiple references to "one embodiment" or to "an embodiment" should not be understood as necessarily all referring to the same embodiment or to different embodiments.

Furthermore, the described features, structures, or characteristics of the invention may be combined in any suitable manner in one or more embodiments. One skilled in the relevant art can recognize, however, that the invention may be practiced without one or more of the specific details, or with other methods, components, materials, and so forth. In other instances, well-known structures, materials, or operations are not shown or described in detail to avoid obscuring aspects of the invention.

The schematic flow chart diagrams included herein are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, and are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

Definitions

Example definitions for some embodiments are now provided.

Artificial turf is a surface of synthetic fibers made to look like natural grass.

Linear-motion bearing (e.g. linear slides) can be designed to provide free motion in one direction. Example linear slides (compound slides, dovetail slides, rack slides, ball bearing-based slides, magnetic slides, etc.) can be non-motorized dovetail slides, ball bearing slides, roller slides, etc. that provide a low-friction linear movement.

Referring to FIG. 1, a simplified block diagram is depicted of an exercise board 100 connected to an external device 120, for example over a network 150. Network 150 may be, for example, a wide area network or a local area network. Additionally, or alternatively, exercise board 100 may be directly connected to external device 120. For example, exercise board 100 may communicate with external device 120 via a wired connection or over a wireless connection (e.g., short range or near-field communications). External device 120 may be a multifunctional device, such as a set-top box, mobile phone, tablet computer, personal digital assistant, wearable device, or any other electronic device that includes a system that can receive content.

Exercise board 100 may include computing or storage devices on which various modules and storage devices may be contained. Although exercise board 100 is depicted as comprising various components in an exemplary manner, in one or more embodiments, the various components and functionality may be distributed across multiple network devices, such as servers, network storage, and the like. Further, additional components may be used, some combination of the functionality of any of the components may be combined. Generally, exercise board 100 may include one or more memory devices 112, one or more storage devices 114, and one or more processors 116, such as a central processing unit (CPU) or a graphical processing unit (GPU). Further, processor 116 may include multiple processors of the same or different type. Memory 112 may include one or more different types of memory, which may be used for performing device functions in conjunction with processor 116. For example, memory 112 may include cache, ROM, and/or RAM. Memory 112 may store various programming modules during execution, including media management module 102, and video editing module 104.

Returning to the exercise board 100, the memory 112 includes modules that include computer readable code executable by processor 116 to cause the exercise board 100 to perform various tasks. As depicted, the memory 112 may include a module 102. According to one or more embodiments, the module 102 may receive sensor data from one or more sensors 118. Module 102 may provide the sensor data upon request from a remote location, such as external device 120. Media management module 102 may store sensor data on storage 114 for subsequent retrieval. Sensor(s) 118 may collect data while the exercise board is in use, as described elsewhere herein. Sensor 118 may be, for example, a pressure sensor mat. In one example, the pressure sensor mat may collect pressure data that is used to create a heat map reading to an external device, such as external device 120. Alternatively, pressure sensor data may be transmitted to an external device for further processing. For example, the pressure sensor data may be sent to external device 140 and external device 120 may create a heat map reading. Collected data may be stored on storage 114.

External device 120 may include one or more servers or other computing or storage devices on which the various modules and storage devices may be contained. Although external device 120 is depicted as comprising various components in an exemplary manner, in one or more embodiments, the various components and functionality may be distributed across multiple network devices, such as servers, network storage, and the like. Further, additional components may be used, some combination of the functionality of any of the components may be combined. Generally, external device 120 may include one or more memory devices 122, one or more storage devices 124, and one or more processors 120, such as a central processing unit (CPU) or a graphical processing unit (GPU). Further, processor 120 may include multiple processors of the same or different type. Memory 122 may include one or more different types of memory, which may be used for performing device functions in conjunction with processor 120. For example, memory 122 may include cache, ROM, and/or RAM. Memory 122 may store various programming modules during execution.

EXAMPLE EMBODIMENTS

Figure 2:
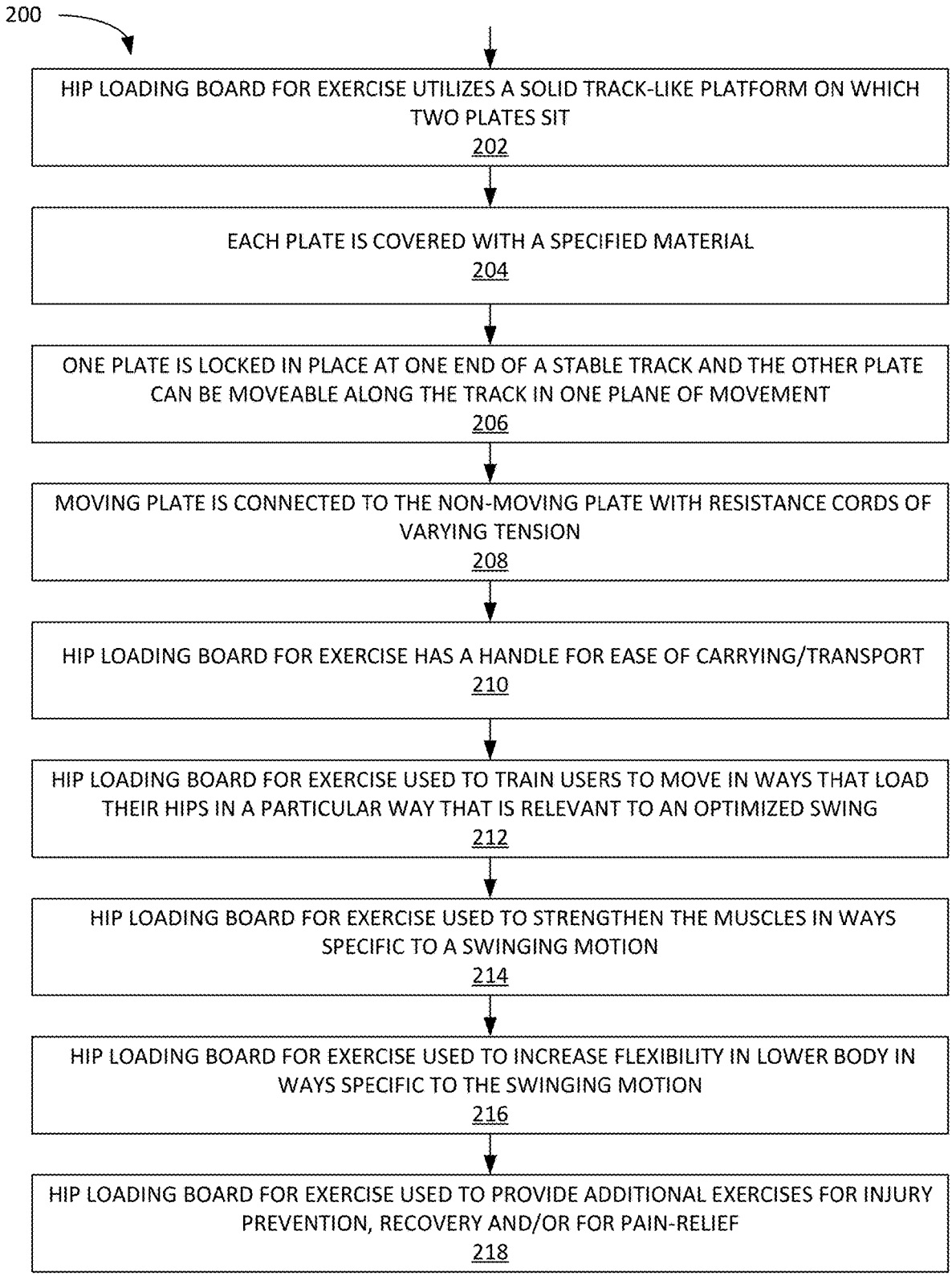
FIG. 2 illustrates an example process for implementing a hip loading board for exercise according to one or more embodiments.

FIG. 2 illustrates an example process for implementing a hip loading board for exercise, according to some embodiments. In step 202, the hip loading board for exercise utilizes a solid track-like platform on which two plates sit. The plates can act as a surface(s) on which a user can place each foot. In step 204, each plate can be covered with a specified material. For example, each plate can be covered with a grass-like cover which replicates golf turf. This can be an artificial turf for replicating various golf playing surfaces. In some examples, a replaceable natural turf surface can be utilized. The covering can be interchangeable (e.g. based on an exercise to be performed/simulated). For example, a set of removable square mats can be provided. Each square mat can have an artificial turf that replicates a specified type of golf grass. In one example, some square mats can have a low friction surface or wobbly surface (e.g. foam, air cushion, balance pad, etc.) for increasing difficulty of an exercise.

In step 206, one plate can be locked in place at one end of a stable track and the other plate can be moveable along the track in one plane of movement. In step 208, the moving plate can be connected to the non-moving plate with resistance cords of varying tension which will increase or decrease. This can depend on how many cords are engaged. The cords can provide the amount of resistance that the non-locked, sliding plate will move. It is noted that other resistance mechanisms (e.g. bands, springs, etc.) can be utilized in lieu of cords. The resistance can also be modifiable with the addition of and/or removal of cords of specified resistance.

In step 210, the hip loading board for exercise can have a handle for ease of carrying/transport. In step 212, the hip loading board for exercise be used to train golfers (and/or other athletes, patients, etc.) to move in ways that load their hips in a particular way that is relevant to an optimized golf swing (and/or other athletic swinging motion, etc.).

In step 214 the hip loading board for exercise also be used to strengthen the muscles in the torso, hips, legs and feet of the user in ways specific to a swinging motion. For example, the swinging motion can be a golf swing. In another example, the swinging motion can be a bat swing, martial arts weapon swing, etc.

In step 216, the hip loading board for exercise can be used to increase flexibility in the lower body in ways specific to the swinging motion. In step 218, the hip loading board for exercise can also be used to provide additional exercises for injury prevention, recovery and/or for pain-relief.

Figure 3:
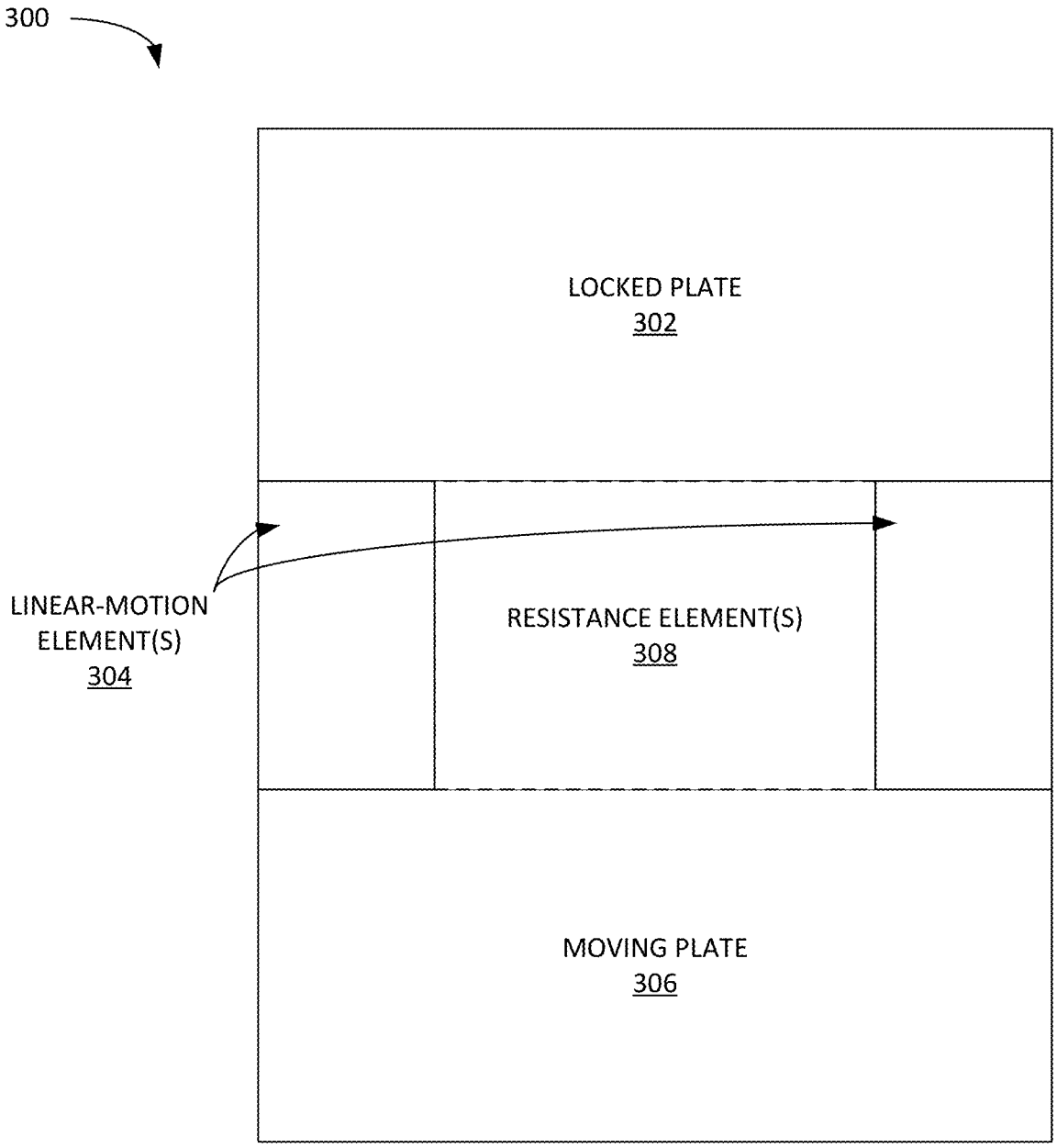
FIG. 3 illustrates an example schematic of a hip loading board for exercise according to one or more embodiments.

FIG. 3 illustrates an example schematic of a hip loading board for exercise 300, according to some embodiments. Hip loading board for exercise 300 can include two plates (e.g. a locked plate 302 and a moving plate 304). The plates can be interchangeable with other plates (e.g. plates with other surface materials). Other surface materials may be synthetic turf, a molded plastic insert for training shoes, or the like. The plates may include pressure sensor mats, as described herein.

Hip loading board for exercise 300 can include linear-motion element(s) 304. Linear-motion element(s) 304 can be a linear-motion bearing motion element (e.g. a linear slide). Linear-motion element(s) 304 can be designed to provide free motion in one direction. This can be in a repeating back and forth manner. Example linear slides (compound slides, dovetail slides, rack slides, ball bearing-based slides, magnetic slides, etc.) can be non-motorized dovetail slides, ball bearing slides, roller slides, etc. that provide a low-friction linear movement.

Hip loading board for exercise 300 can include resistance element(s) 308. Resistance elements 308 can provide resistance to the linear motion of moving plate 304. Resistance elements 308 can provide a force to return moving plate 304 to a start position as well. Resistance elements 308 can be interchangeable to create variable resistance. Resistance elements 308 can be any system/element that provides linear resistance (e.g. any material which creates a constant resistance or tension, variable resistance or tension, etc.). This can include weighted spring(s). This can include heavy-duty rubber to create variable resistance. This can include magnetic resistance systems. This can include polymer rods to create constant resistance or tension.

Figure 4A:
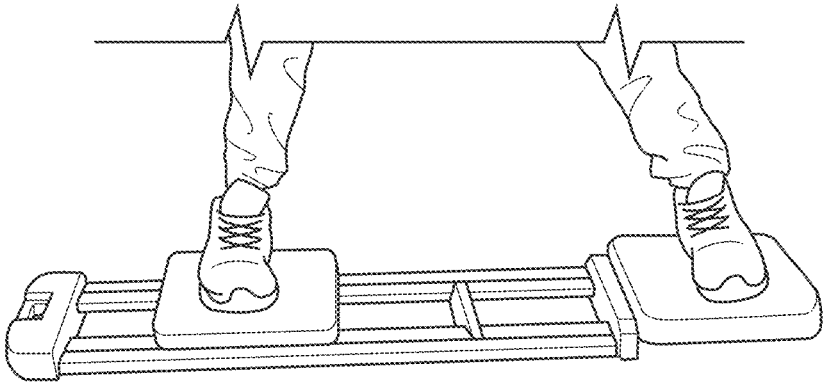
FIGS. 4A and 4B illustrate example use of a hip loading board for exercise according to one or more embodiments.
Figure 4B:
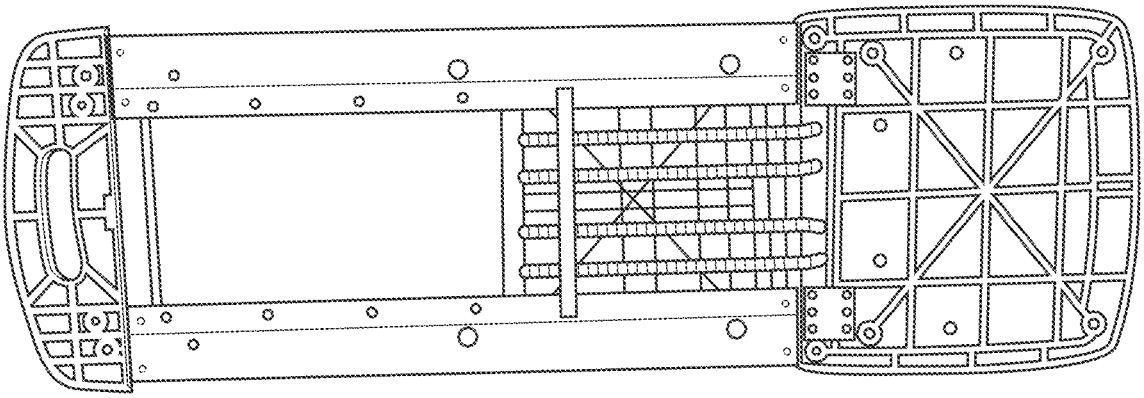

FIG. 4A illustrates an example use of a hip loading exercise board. As shown, a user may stand with one foot on each of the plates of the exercise board. In this example, the back plate may be moveable along a track of the exercise board. As the user goes through their motion (e.g., a golf swing), the two plates may move closer to one another. FIG. 4B illustrates the underside of the hip loading exercise board. In this example, resistance bands are shown. In different embodiments, a varying number of resistance bands may be used. In this example, four resistance bands are shown. Resistance bands of varying tension may be used based on a skill level, or fitness level, of a user.

Figure 5A:
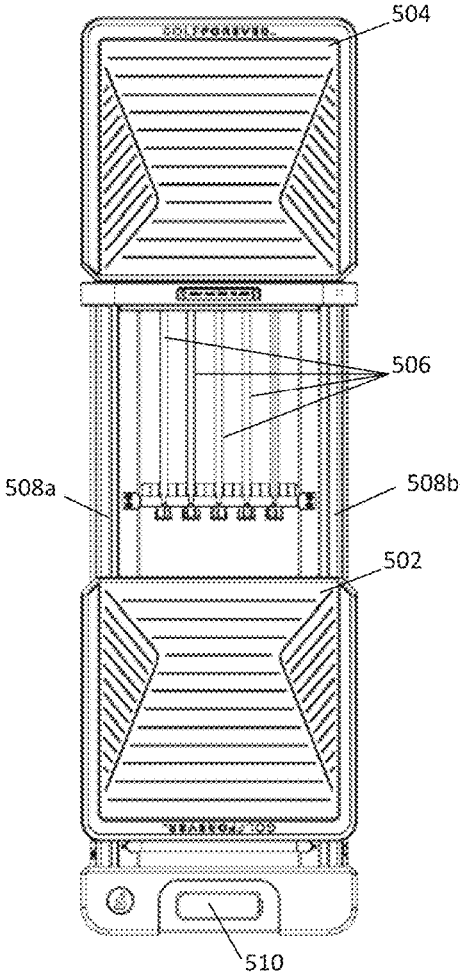
FIGS. 5A-5C illustrate exemplary views of a fully extended hip loading board for exercise according to one or more embodiments.
Figure 5B:
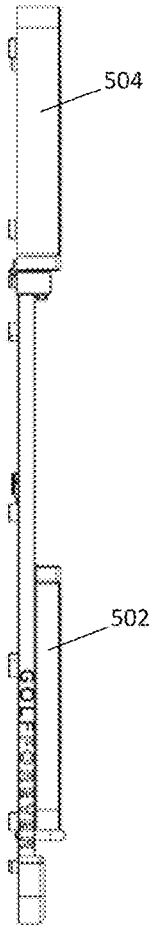
Figure 5C:
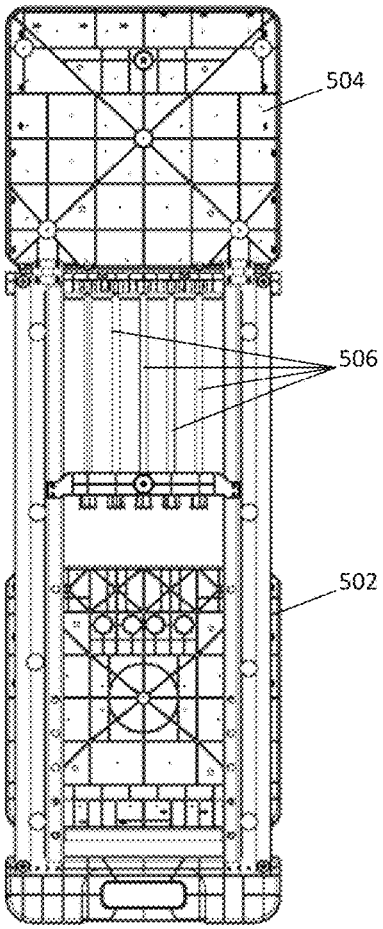

FIGS. 5A-5C illustrate exemplary views of a fully extended hip loading board for exercise according to one or more embodiments. The hip loading board for exercise can include two plates (e.g. a locked plate 502 and a moving plate 504). The plates can be interchangeable with other plates (e.g. plates with other surface materials). Other surface materials may be synthetic turf, a molded plastic insert for training shoes, or the like. The plates may include pressure sensor mats, as described herein.

Hip loading board for exercise 500 can include linear-motion element(s) 504. Linear-motion element(s) 504 can be a linear-motion bearing motion element (e.g. a linear slide). Linear-motion element(s) 504 can be designed to provide free motion in one direction. This can be in a repeating back and forth manner. Example linear slides (compound slides, dovetail slides, rack slides, ball bearing-based slides, magnetic slides, etc.) can be non-motorized dovetail slides, ball bearing slides, roller slides, etc. that provide a low-friction linear movement.

Hip loading board for exercise can include resistance element(s) 506. Resistance elements 506 can provide resistance to the linear motion of moving plate 504. Resistance elements 506 can provide a force to return moving plate 504 to a start position as well. Resistance elements 506 can be interchangeable to create variable resistance. Resistance elements 506 can be any system/element that provides linear resistance (e.g. any material which creates a constant resistance or tension, variable resistance or tension, etc.). This can include weighted spring(s). This can include heavy-duty rubber to create variable resistance. This can include magnetic resistance systems. This can include polymer rods to create constant resistance or tension. Additionally, the exercise board may include a handle 510 for easy transport. FIG. 5B provides a side view of the exercise board. FIG. 5C provides a bottom view of the exercise board.

Figure 6A:
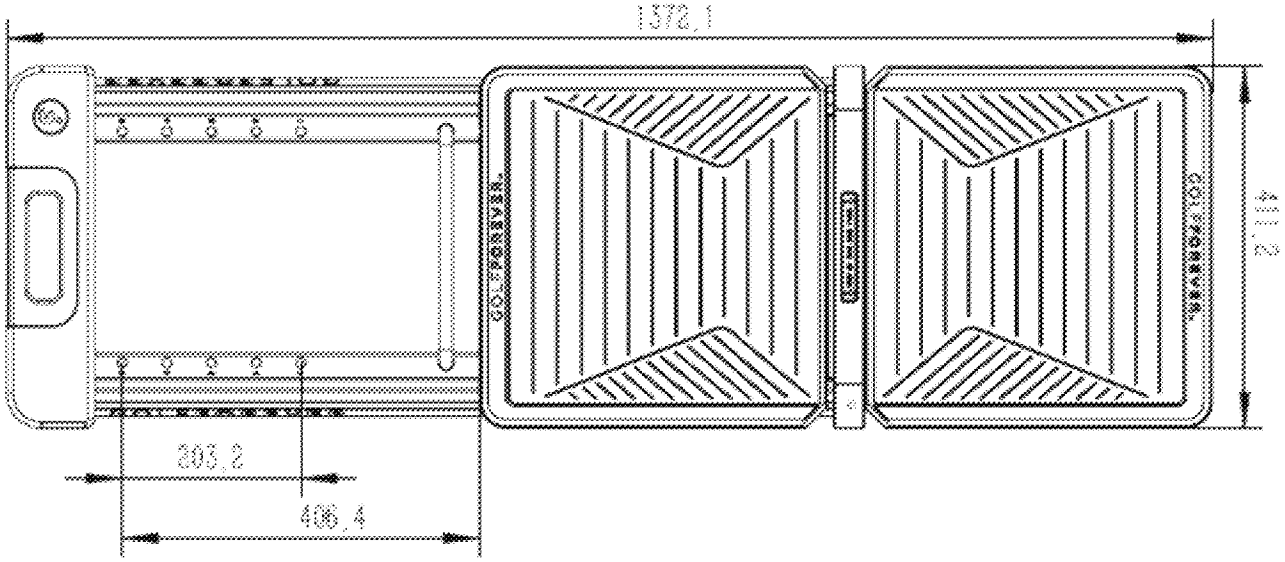
FIGS. 6A-6C illustrate exemplary views of a hip loading board for exercise according to one or more embodiments.
Figure 6B:
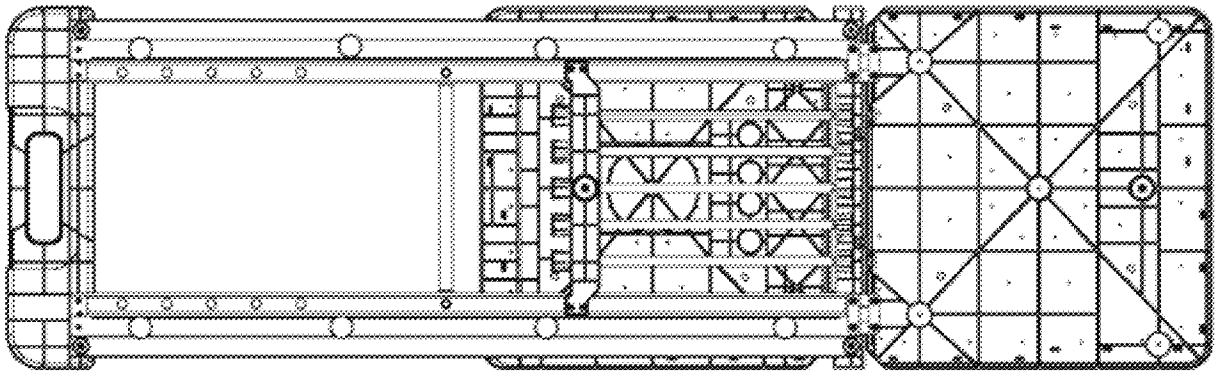
Figure 6C:
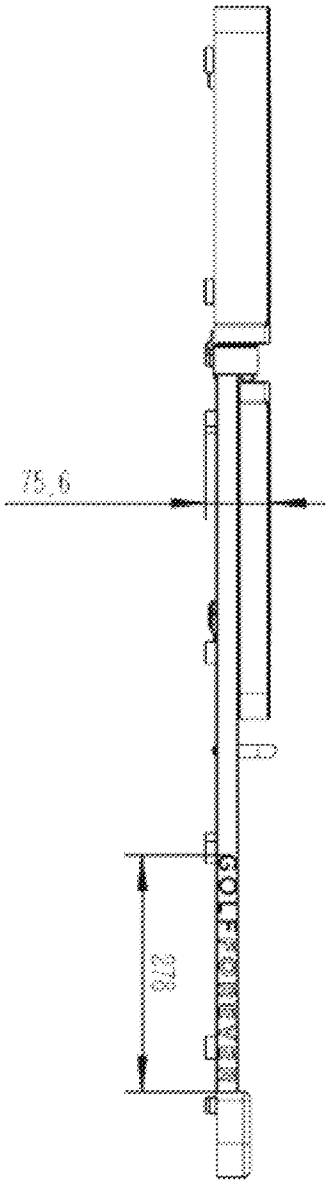
Figure 7C:
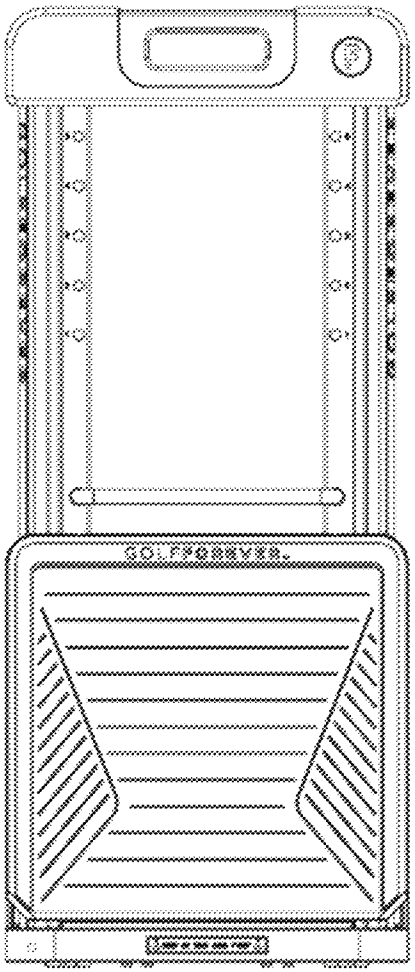
FIGS. 7A-7C illustrate exemplary views of a folded hip loading board for transportation according to one or more embodiments.
Figure 7B:
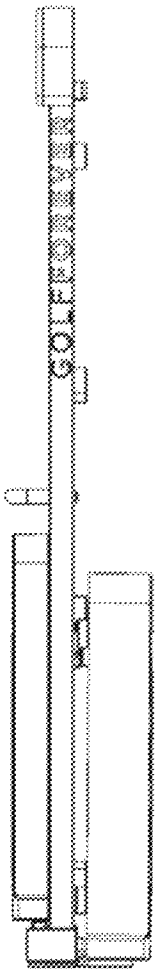
Figure 7A:
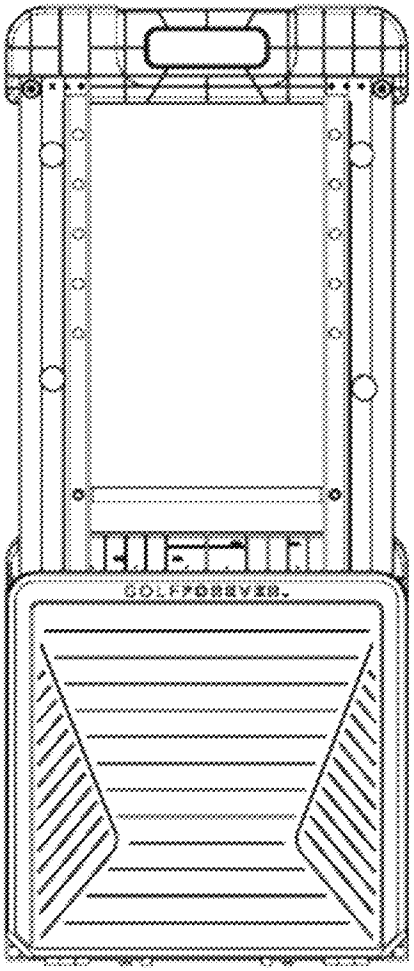

FIGS. 6A-6C provide additional exemplary views of a hip loading board for exercise according to one or more embodiments as described herein. FIGS. 7A-7C provide exemplary views of a folded hip loading board for transportation according to one or more embodiments. In some embodiments, one or more hinges may be provided to allow folding of the exercise board. A handle may be provided as part of the board to allow for easy transport.

The above discussion is meant to be illustrative of the principles and various embodiments of the present disclosure. Numerous variations and modifications will become apparent to those skilled in the art once the above disclosure is fully appreciated. It is intended that the following claims be interpreted to embrace all such variations and modifications.

What is claimed is:

1. A hip loading exercise board, comprising:

a base frame including one or more tracks;

a first plate fixedly connected to the one or more tracks;

a second plate moveably connected to the one or more tracks in one plane of movement;

one or more resistance elements connected to the second plate; and one or more processors and one or more memory devices in communication with the one or more processors, wherein at least one of the first plate or the second plate includes a pressure sensor that is configured to communicate pressure sensor data to the one or more processors for storage in the one or more memory devices, and wherein the one or more processors are configured to transmit the pressure sensor data to an external device.

2. The hip loading exercise board of claim 1, wherein the first plate is removeable and the second plate is removeable.

3. The hip loading exercise board of claim 1, wherein the one or more resistance elements comprise one or more resistance cords.

4. The hip loading exercise board of claim 1, wherein at least one of the first plate or the second plate includes a molded insert configured to receive a training shoe.

5. The hip loading exercise board of claim 1, wherein at least one of the first plate or the second plate includes a synthetic turf insert for spiked footwear.

6. The hip loading exercise board of claim 1, wherein the pressure sensor data is used to create a heat map that is displayed on the external device.

7. The hip loading exercise board of claim 6, wherein the heat map is created using the one or more processors of the hip loading exercise board.

8. The hip loading exercise board of claim 1, further comprising at least one handle.

9. The hip loading exercise board of claim 1, wherein the one or more processors are configured to wirelessly transmit the pressure sensor data to the external device.

10. The hip loading exercise board of claim 9, wherein the one or more processors are configured to wirelessly transmit the pressure sensor data to the external device using short-range communications or near-field communications.

11. The hip loading exercise board of claim 9, wherein the external device is at least one of a set-top box, a mobile phone, a tablet computer, a personal digital assistant, or a wearable device.

12. The hip loading exercise board of claim 1, wherein at least one of the first plate or the second plate includes foam, an air cushion, or a balance pad to create an unstable surface.

13. The hip loading exercise board of claim 1, wherein the one or more tracks include one or more linear slides.

14. The hip loading exercise board of claim 13, wherein the one or more linear slides are compound slides, dovetail slides, rack slides, ball bearing based slides, or magnetic slides.

15. The hip loading exercise board of claim 1, wherein the one or more resistance elements cause constant resistance or tension.

16. The hip loading exercise board of claim 1, wherein the one or more resistance elements cause variable resistance or tension.

17. The hip loading exercise board of claim 1, wherein the one or more resistance elements are magnetic resistance systems.

18. The hip loading exercise board of claim 1, wherein the one or more resistance elements are polymer rods.

* * * * *